United States Patent [19]

Waki et al.

[11] Patent Number: 5,003,351

[45] Date of Patent: Mar. 26, 1991

[54] IMAGE FORMING APPARATUS

[75] Inventors: Kenichiro Waki; Nobuhiro Hayashi, both of Yokohama, Japan

[73] Assignee: Canon Kabushiki Kaisha, Tokyo, Japan

[21] Appl. No.: 398,545

[22] Filed: Aug. 25, 1989

[30] Foreign Application Priority Data

Aug. 29, 1988 [JP] Japan ..... 63-214375

[51] Int. Cl.[5] ..... G03G 15/01; G03G 15/09

[52] U.S. Cl. ..... 355/245; 355/251; 355/259; 355/327; 355/328; 118/658; 118/645

[58] Field of Search ..... 355/245, 251, 253, 326–328, 355/259; 118/657, 658, 645, 651

[56] References Cited

U.S. PATENT DOCUMENTS

| | | | |
|---|---|---|---|
| 4,591,261 | 5/1986 | Saruwatari et al. | 355/251 |
| 4,827,869 | 5/1989 | Takagi | 118/651 X |
| 4,833,504 | 5/1989 | Parker et al. | 355/326 X |

*Primary Examiner*—R. L. Moses

*Attorney, Agent, or Firm*—Fitzpatrick, Cella, Harper, Scinto

[57] ABSTRACT

An image forming apparatus includes an image bearing member, a latent image forming device for forming an electrostatic latent image on the image bearing member, a first developing device including a first developer carrying member for carrying a first developer thereon to supply it to the image bearing member, a second developing device including a second developer carrying member for carrying thereon a second developer having a different color from that of the first developer to supply it to the image bearing member, wherein a developer carrying surface of the developer carrying member has a surface property which is different from that of the first developer carrying member, and a bias voltage applying device for applying a first developing bias voltage to the first developer carrying member and for applying to the second developer carrying member a second bias voltage which is different from the first developing bias voltage.

16 Claims, 2 Drawing Sheets

IMAGE FORMING APPARATUS

FIELD OF THE INVENTION AND RELATED ART

The present invention relates to an image forming apparatus such as an electrophotographic apparatus or an electrostatic recording apparatus, more particularly to an image forming apparatus equipped with a plurality of developing devices and capable of forming multi-color images and full-color images.

Together with expansion of variety of functions in an image forming apparatus such as an electrophotographic copying machine, an increasing number of copying machine are provided with a multi-color copying functions, typically a full-color copy function, in addition to a monochromatic black copy function.

Referring first to FIG. 4, a conventional image forming apparatus of an electrophotographic type is shown which is equipped with two developing devices and which is capable of forming a multi-color copy image in two colors.

In this example, the copying apparatus has a latent image bearing member (drum) in the form of a drum of an electrophotographic photosensitive member, which is rotatably supported in the apparatus. During rotation of the drum 1 in the direction indicated by an arrow, the surface thereof passes by latent image forming means including a charger 2 and an exposure station 3 for exposing the drum to information light, by which an electrostatic latent image is formed on the drum.

Around the drum 1, first and second developing devices 4 and 5 are disposed, and the latent image on the drum 1 is developed into a visual image by a selected one of the developing devices.

More particularly, a two color image forming apparatus, includes the first and second developing devices 4 and 5 normally contain different color developers (toner). A selected one of the developing devices is brought to the neighborhood of the drum where it develops the latent image, whereas the other developing device is retained at a position away from the drum and is not operated.

Subsequently, a second latent image is formed on the drum 1, and the second latent image is developed into a visual toner image by the other one of the developing devices.

The toner image formed now on the drum in two colors is transferred, in a transfer-separation station 7, onto a transfer material P fed to the station 7. The transfer material P is then separated from the drum and is conveyed to an image fixing station 8 where the transferred image is fixed on the transfer material into a permanent image. The toner not transferred onto the transfer material P from the drum is removed from the drum by a cleaner 9.

Generally, each of the developing devices 4 and 5 includes a movable developing sleeve 12*a* or 12*b* in the form of a cylinder for conveying the developer into a developing zone and supplying it to the drum 1 in the developing zone. The developer carrying surface of the developing sleeve is roughened in order to enhance the conveyance of the developer and in order to triboelectrically charge the developer (U.S. Pat. Nos. 4,377,332 and 4,380,966).

In an image forming apparatus having plural developing devices, the developing devices contain different color toners (resin particles each containing pigment or dye in mixture). Therefore, the surface properties of the sleeves 12*a* and 12*b* are different to match the respective toners used in consideration of degree of the triboelectric charge hardness of the resin or the like, and it is preferable that the surface properties are different for the respective developing devices.

For example, if the toner used in the developing device 4 is easily triboelectrically charged by friction with the sleeve, the surface of the sleeve 12*a* is preferably blasted with irregular particles in order to prevent excessive triboelectrical charging. On the other hand, if the resin component of the toner used in the developing device is easily scraped, and the surface of the sleeve is easily contaminated by the scraped resin, the surface of the sleeve 12*b* is preferably blasted with regular particles in order to prevent the same. In this specification "regular particles" means the particles having round surfaces without corner edges, such as spherical, oval or flat spherical particles; whereas "irregular particles" means particles having irregular shapes with plural corner edges. The surface of the sleeve blasted with the irregular particles with air pressure, that is, the sleeve surface blast-treated with the irregular particles is a roughened surface having fine acute projections. Therefore, it is effective to prevent the excessive triboelectric charge, but is easily contaminated with the resin component of the toner. On the other hand, the sleeve surface blasted with the regular particles with air pressure, that is, the sleeve surface blast-treated with the regular particles is a roughened surface with fine smooth concavities. Therefore, it is not easily contaminated with the resin component of the toner, but it easily charge the toner with triboelectricity.

However, when the toner carrying surface of the sleeve 12*a* is blast-treated with the irregular particles so as to match it with the property of the toner used in the developing device 4, while the toner carrying surface of the sleeve 12*b* is blast-treated with regular particles so as to match it with the property of the toner used in the developing device 5, the following problems has been recognized. The color image provided by the development by the developing device 4 with the color toner was good. However, the image provided by the development by the developing device 5 with the black toner had a foggy background. When the developing bias voltage was adjusted by the developing bias voltage source 6 so as to prevent the foggy background of the black toner, the image provided by the developing device 4 was not sufficient in the image density.

SUMMARY OF THE INVENTION

Accordingly, it is a principal object of the present invention to provide an image forming apparatus by which plural color toner images can be provided with good image quality.

The inventors have carried out various investigations and test to find the causes of the problems. It was found that the developing properties were different if the surface properties of the sleeve were different. More particularly, the developing action is much influenced by the amount of triboelectric charge of the toner. Generally, if the amount of the triboelectric charge of the toner is large, the image density is increased, and the fog is also increased. The amount of the triboelectric charge of the toner tends to increase with increase of the ratio of the flat areas on the sleeve surface. In the conventional apparatus, the same developing bias voltage is applied to the respective sleeves of the plural developing device. Thus, the cause of the above problems have been concluded as being the application of the same developing bias voltage to the sleeves as in the conventional manner, despite the fact that the sleeves having different surface properties are used. Accordingly, in the present invention, different developing bias voltages are applied to the developer carrying members of the respective developing devices so as to match the surface properties of the developer carrying member, by which good multi-color images can be provided.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
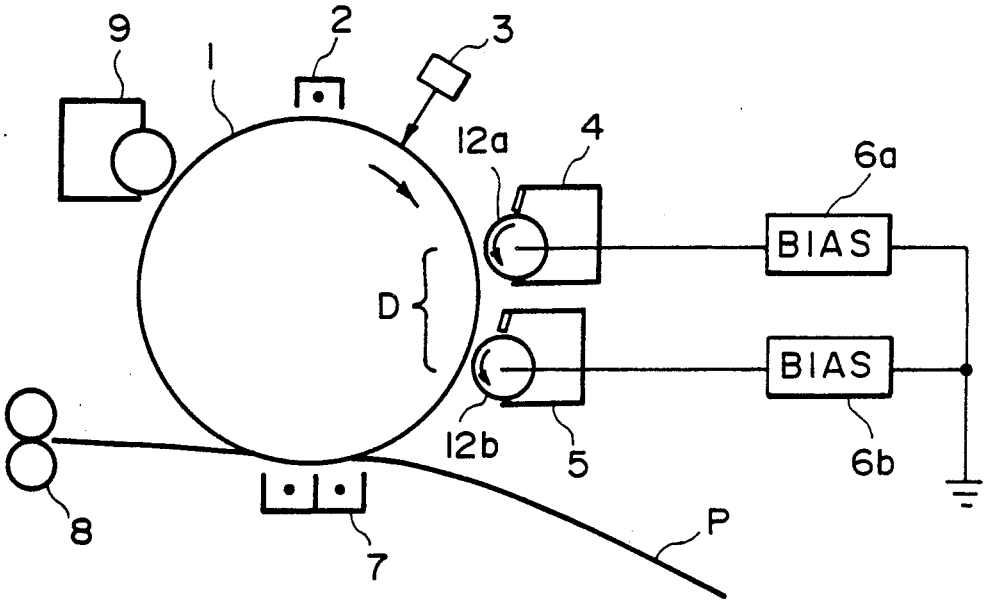
FIG. 1 is a schematic view of an image forming apparatus according to an embodiment of the present invention.
Figure 4:
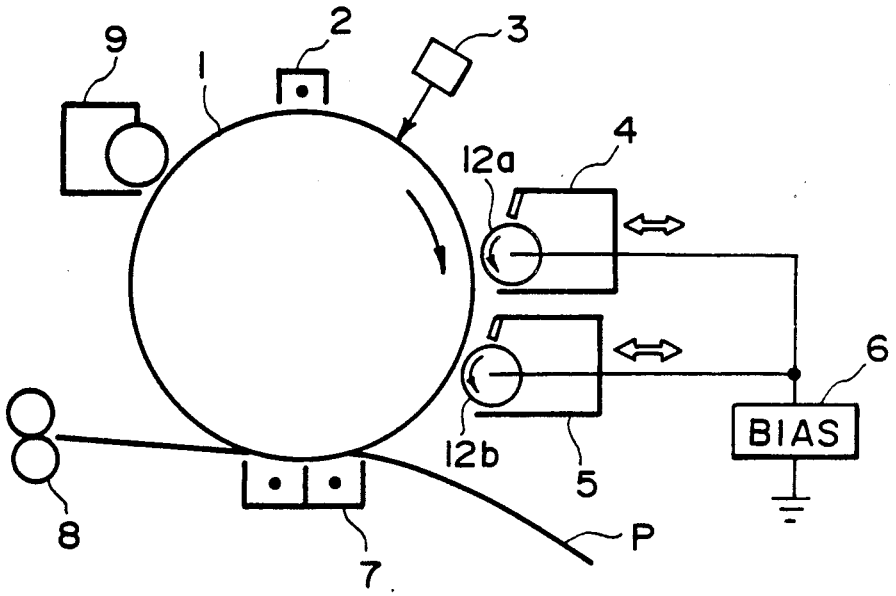
FIG. 4 PRIOR ART
FIG. 4 is a schematic view of a conventional image forming apparatus.

Referring to FIG. 1, there is shown an image forming apparatus according to an embodiment of the present invention. The apparatus is of an electrophotographic type capable of forming two color image copy and is provided with two developing devices 4 and 5. The same reference numerals as in FIG. 4 are assigned to the elements having corresponding functions.

The apparatus includes a latent image bearing member 1 in the form of a drum such as an electrophotographic photosensitive member, which is rotatably supported. During rotation of the latent image bearing member 1, the surface thereof passes by latent image forming means including a charger 2 and an exposure station 3, by which a latent image is formed on the latent image bearing member 1. In this embodiment, the latent image bearing member 1 is uniformly charged by a charger 2 to −650 V, and exposed to light image at the exposure station 3, so that a latent image is formed.

In the two color image forming apparatus of this embodiment, the first developing device 4 contains non-black chromatic toner, whereas the second developing device contains black toner, although the colors may be different. One of the developing devices containing a selected color toner is brought close to the drum to perform its developing operation, while the other developing device is retained at a position away from the drum without performing the developing operation.

The two toner image formed on the latent image bearing member 1 by development of the developing devices 4 and 5, are transferred, at the transfer-separation station 7, onto a transfer material P conveyed to the station. Then, the transfer material P is separated from the drum 1 and is fixed on the transfer material into a permanent image at the fixing station. The residual toner remaining on the drum 1 without being transferred onto the transfer material is removed by the cleaning device 9.

Figure 3:
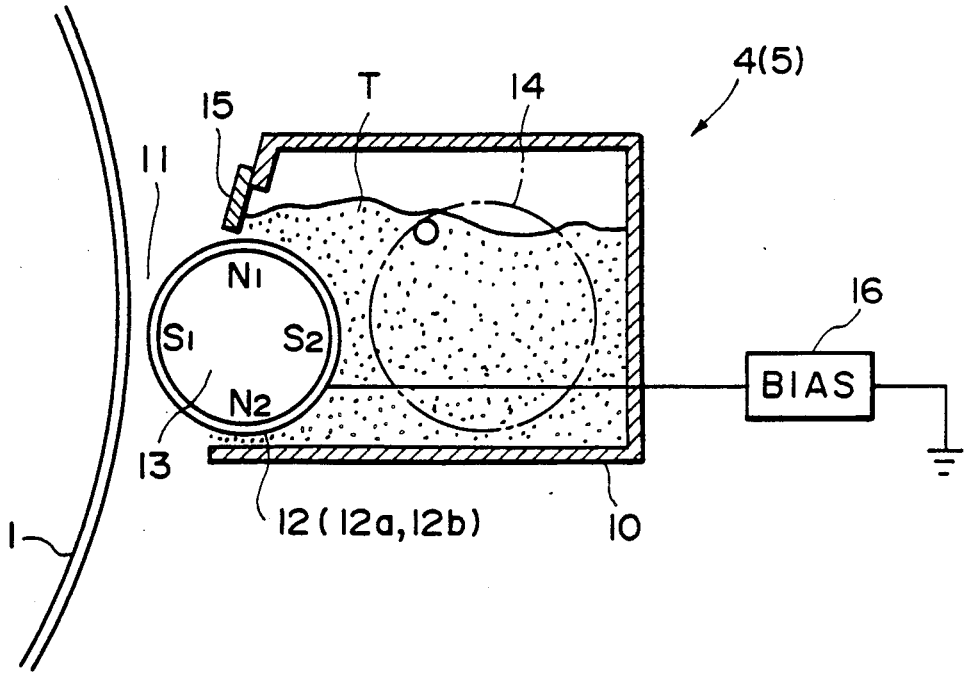
FIG. 3 is a sectional view of a developing device usable with an image forming apparatus according to en embodiment of the present invention.

Referring to FIG. 3, the developing device used with the image forming apparatus described above will be explained. Each of the developing devices 4 and 5 includes a developer container 10 containing one component magnetic developer (toner) T, for example and a rotatable developer carrying member 12 for carrying the toner T from the developer container 10 into a developing zone 11 for developing the latent image on the drum 1. The developer carrying member 12 is normally made of non-magnetic material into a cylinder, and is provided with a stationary magnet 13. In the developer container 10, there are a stirring member 14 for supplying the toner T to the surface of the developer carrying member 12 (sleeve) and a developer regulating member 15 for regulating an amount of the toner to be conveyed to the developing zone 11 by the sleeve 12.

The toner particles on the sleeve 12 in the developing zone 11 are formed into chains of the toner particles by the magnetic pole S1 of the magnet 13 in the sleeve, and the chains are faced to the drum 1. On the other hand, the sleeve 12 is supplied with a bias voltage from a developing bias source 16 which will be described hereinafter. The bias voltage is an AC voltage superposed with a DC voltage. By the application of the bias voltage, a vibration electric field having alternately changing directions is formed between the drum 1 and the sleeve 12 in the developing zone. By the vibrating electric field, the toner is released from the sleeve and is transferred onto the drum 1 to develop the latent image. The thickness of a layer of the developer carried on the sleeve 12 may be smaller than the minimum clearance between the drum 1 and the sleeve 12 at the developing zone 11. Alternatively, it may be thicker than the minimum clearance between the drum 1 and the sleeve 12, and in this case, the developer layer is contacted to the drum 1 in the developing zone.

In this embodiment, the sleeve **12*a* of the first developing device 4 has a developer carrying surface (peripheral surface) having been blast-treated with irregular particles of alumina, $A1_2O_3$ having a grain size of #400, approximately. The developer carrying surface (peripheral surface) of the sleeve 12*b*of the second developing device 5** has been blast-treated with regular particles of glass beads having a grain size of #400, approximately.

EXAMPLE 1

Image forming operations were performed using the developing devices 4 and 5 described above.

In this example, the sleeve **12*a* of the first developing device 4 was supplied by the first developing bias source 6*a* with a DC-biased AC voltage provided by superposition of a DC voltage Vdc of −200 V and an AC voltage having a peak-to-peak voltage (an absolute value of a difference between a positive maximum voltage and a negative minimum voltage) Vpp of 1300 V, frequency f of 2000 Hz. The sleeve 12*b* of the second developing device 5 is supplied by a second developing bias source 6*b* different from the first source 6*a*** with a DC-biased AC voltage provided by superposition of a DC voltage Vdc of −200 V and an AC voltage having a peak-to-peak voltage Vpp of 1000 V which is smaller than the peak-to-peak voltage Vpp of the first developing bias voltage and frequency f of 2000 Hz (the frequency and the DC component are the same as in the first developing bias voltage).

With this structure, a good image having a high image density and not having foggy background was provided by the first developing device 4, and also a good image having a high image density and not having the foggy background (high triboelectric charge) was provided by the second developing device.

EXAMPLE 2

Using the same developing devices 4 and 5 as in the Example 1, image forming operations were carried out.

In this example, the first sleeve 12*a* was supplied by the first developing bias source 6*a* with a DC-biased AC voltage provided by superposition of a DC voltage Vdc of −200 V and an AC voltage having the peak-to-peak voltage Vpp of 1300 V and frequency f of 2000 Hz. The second 12*b* was supplied by the second developing bias source 6*b* with a DC-biased AC voltage provided by superposition of a DC voltage Vdc of −200 V and an AC voltage having peak-to-peak voltage Vpp of 1300 V and frequency f of 2300 Hz (Vpp and Vdc are the same as with the first developing bias, but f is higher than that of the first developing bias voltage).

The same results were observed as with Example 1.

EXAMPLE 3

Using the same developing devices 4 and 5 as in Example 1, image forming operations were performed.

In this embodiment, the first sleeve 12*a* was supplied by the first developing bias source 6*a* with a DC-biased AC voltage provided by superposition of a DC voltage Vdc of −200 V and an AC voltage having a peak-to-peak voltage Vpp of 1300 V and a frequency of 200 Hz. The second sleeve 12*b* was supplied by the second developing bias source 6*b* which is different from the first source 6*a* with a DC-biased AC voltage provided by superposition of a DC voltage Vdc of −230 V and an AC voltage having a peak-to-peak voltage Vpp of 1300 V and a frequency f of 2000 Hz (Vpp and f are the same as the first developing bias voltage, but Vdc is larger than that of the first developing bias voltage in the absolute value).

The same good results were observed as with Example 1.

EXAMPLE 4

Using the same developing devices 4 and 5 as in Example 1, the image forming operations were performed.

In this example, the first sleeve 12*a* was supplied by the first developing bias source 6*a* with a first DC-biased AC developing bias voltage provided by superposition of a DC voltage Vdc of −200 V and an AC voltage having a peak-to-peak voltage Vpp of 1300 V and a frequency f of 2000 Hz. The first sleeve 12*b* was supplied by the second developing bias source 6*b* which is different from the first source 6*a* with a second DC-biased AC voltage provided by superposition of a DC voltage Vdc of −210 V and an AC voltage having a peak-to-peak voltage of 1200 V and a frequency f of 2200 Hz (Vpp is smaller than that of the first developing bias voltage, but f and Vdc. are larger than that of the first developing bias voltage).

The same good results were observed as with Example 1.

EXAMPLE 5

Figure 2:
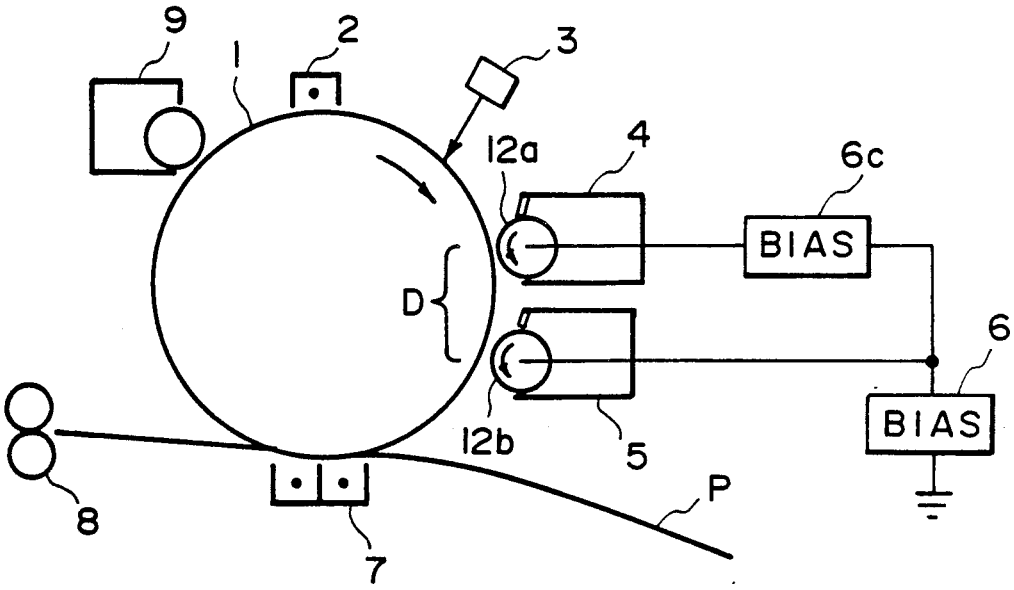
FIG. 2 is a schematic view of an image forming apparatus according to another embodiment of the present invention.

In this example, as shown in FIG. 2, a common bias source 6 was used to apply the bias voltages to the first and second sleeves 12*a* and 12*b*, and a converter 6*c* in the form of load, for example, such as resistor was connected between the common source 6 and the sleeve 12*a* of the first developing device 4, by which the first and second sleeves 12*a* and 12*b* were supplied with voltages having different peak-to-peak voltages Vpp and/or the DC component Vdc.

The same good results were confirmed as with Example 1, when the developing devices had this structure.

From the foregoing, it is understood that the bias voltage applied to the sleeve significantly changes with the peak-to-peak voltage Vpp of the AC component, a DC voltage Vdc of the DC component and the frequency f. The density is increased by increasing the peak-to-peak voltage Vpp, by decreasing Vdc, and/or decreasing the frequency f; and the occurrence of the fog can be reduced by decreasing the peak-to-peak voltage Vpp, increasing Vdc and/or increasing the frequency f.

According to the present invention, the developing bias voltage applied to the developing device including a developer carrying member having a surface in which a ratio of smooth portions is large is such that the peak-to-peak voltage Vpp of an AC voltage component is lower, a frequency f thereof is higher, and/or an absolute value of the voltage of a DC voltage component Vdc is larger, than those of the developing bias voltage applied to the other developing device. In other words, the developing bias voltage applied to a developing device including a developer carrying member having a surface blast-treated by regular particles is such that the peak-to-peak voltage Vpp of the AC voltage component is lower, the frequency f thereof is higher, and/or the absolute value of the voltage of the DC voltage component Vdc is larger, than those of the developing bias applied to the developing device including a developer carrying member having a surface blast-treated with irregular particles.

It is preferable that the level of the voltage of the DC component Vdc of the developing bias voltage is between a light potential level and a dark potential level of the latent image to be developed, and that the light potential level and the dark potential level of the latent image are between the maximum voltage and the minimum voltage.

The present invention is usable in a system wherein all or a part of plural developing devices use two component developer containing toner and carrier particles.

The alternating voltage component of the developing bias voltage may be in the form of a rectangular wave, a sine wave, triangular wave or another wave.

In the foregoing embodiments, a two-color image forming apparatus of an electrophotographic type has been taken. However, the present invention is applicable to an image forming apparatus wherein plural color developing devices are selectively usable, or two a multi-color (two or more colors) or full-color image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

latent image forming means for forming an electrostatic latent image on said image bearing member;

first developing means including a first developer carrying member for carrying a first developer thereon to supply it to said image bearing member;

second developing means including a second developer carrying member for carrying thereon a second developer having a different color from that of the first developer to supply it to said image bearing member, wherein a developer carrying surface of said second developer carrying member has a surface property which is different from that of said first developer carrying member; and bias voltage applying means for applying a first developing bias voltage to said first developer carrying member and for applying to said second developer carrying member a second bias voltage which is different from the first developing bias voltage;

wherein the developer carrying surface of said first developer carrying member is a treated surface, and the developer carrying surface of said second developer carrying member is differently treated surface.

2. An apparatus according to claim 1, wherein the developer carrying surface of said developer carrying member is a surface blast-treated with irregular particles, and wherein the developer carrying surface of said developer carrying member is a surface blast-treated with regular particles.

3. An image forming apparatus, comprising:

an image bearing member;

latent image forming means for forming an electrostatic latent image on said image bearing member;

first developing means including a first rotatable developer carrying member for carrying thereon a first developer to supply it to said image bearing member, wherein the first rotatable developer carrying member has a developer carrying surface blast-treated in a first manner;

second developing means including a second rotatable developer carrying member for carrying thereon a second developer having a different color from that of the first developer to supply it to said image bearing member, wherein said second rotatable developer carrying member has a developer carrying surface blast-treated in a second manner which is different from the first manner; and bias voltage applying means for applying to said first rotatable developer carrying member a first developing bias voltage having an AC component, and for applying to said second rotatable developer carrying member a second developing bias voltage having an AC component, wherein said first developing bias voltage and said second developing bias voltage are different at least in one of a peak-to-peak voltage of the AC component, a frequency of the AC component and a voltage level of the DC component.

4. An apparatus according to claim 3, wherein in the first manner irregular particles are used for the blasting, and wherein in the second manner, regular particles are used for the blasting.

5. An apparatus according to claim 4, wherein the peak-to-peak voltage of the AC component of the second developing bias voltage is smaller than that of the first developing bias voltage.

6. An apparatus according to claim 4, wherein the frequency of the AC component of the second developing bias voltage is higher than that of the first developing bias voltage.

7. An apparatus according to claim 4, wherein an absolute value of the DC component of the second developing bias voltage is larger than that of the first developing bias voltage.

8. An image forming apparatus, comprising:

an image bearing member;

electrostatic latent image forming means actable on said image bearing member;

first developing means including a first rotatable developer carrying member for carrying a first developer thereon to supply it to said image bearing member;

second developing means including a second rotatable developer carrying member for carrying thereon a second developer having a different color from that of the first developer to supply it to said image bearing member, wherein a developer carrying surface of said first developer carrying member is a treated surface, and a developer carrying surface of said second developer carrying member is differently treated surface; and bias voltage applying means for applying a first developing bias voltage to said first developer carrying member and for applying to said second developer carrying member a second bias voltage which is different from the first developing bias voltage.

9. An apparatus according to claim 8, wherein the developer carrying surface of said first rotatable developer carrying member is a surface blast-treated in a first manner, and the developer carrying surface of said second rotatable developer carrying member is a surface blast-treated in a second manner.

10. An apparatus according to claim 8 or 9, wherein said first developing bias voltage has an AC component, and said second developing bias voltage has an AC component, wherein said first developing bias voltage and said second developing bias voltage are different at least in one of a peak-to-peak voltage of the AC component, a frequency of the AC component and a voltage level of the DC component.

11. An apparatus according to claim 8 or 9, further comprising:

means for transferring onto a transfer material a visualized image formed by said first developing means and second developing means on image bearing member.

12. An image forming apparatus, comprising:

an image bearing member;

electrostatic latent image forming means actable on said image bearing member;

first developing means including a first rotatable developer carrying member for carrying a first developer thereon the supply it to said image bearing member;

second developing means including a second rotatable developer carrying member for carrying thereon a second developer having a different color from that of the first developer to supply it to said image bearing member, wherein a developer carrying surface of said first developer carrying member and a developer carrying surface of said second developer carrying member have different roughnesses; and bias voltage applying means for applying a first developing bias voltage to said first developer carrying member and for applying to said second developer carrying member a second bias voltage which is different from the first developing bias voltage.

13. An apparatus according to claim 12, wherein the difference of the roughness is in configurations of fine pits and projections of said developer carrying surface of said first developer carrying member and those of said developer carrying surface of said second developer carrying member.

14. An apparatus according to claim 13, wherein the developer carrying surface of said first rotatable developer carrying member is a surface blast-treated in a first manner, and the developer carrying surface of said second rotatable developer carrying member is a surface blast-treated in a second manner.

15. An apparatus according to one of claims 12 to 14, wherein said first developing bias voltage has an AC component, and said second developing bias voltage and component, and wherein said first developing bias voltage and said second developing bias voltage are different at least in one of a peak-to-peak voltage of the AC component, a frequency of the AC component and a voltage level of the DC component.

16. An apparatus according to one of claim 12 to 14, further comprising:

means for transferring onto a transfer material a visualized image formed by said first developing means and second developing means on said image bearing member.

* * * * *

UNITED STATES PATENT AND TRADEMARK OFFICE

CERTIFICATE OF CORRECTION

PATENT NO. : 5,003,351

DATED : March 26, 1991

INVENTOR(S) : KENICHIRO WAKI, ET AL.

It is certified that error appears in the above-identified patent and that said Letters Patent is hereby corrected as shown below:

ON THE TITLE PAGE,
IN [56] REFERENCES CITED

Attorney, Agent, or Firm: "Fitzpatrick, Cella, Harper, Scinto" should read --Fitzpatrick, Cella, Harper & Scinto--.

ON THE TITLE PAGE,
IN [57] ABSTRACT

Line 11, "the developer" should read --second developer--.

COLUMN 3

Line 26, "en" should read --an--.

COLUMN 8

Line 55, "the" should read --to--.

UNITED STATES PATENT AND TRADEMARK OFFICE

CERTIFICATE OF CORRECTION

PATENT NO. : 5,003,351

DATED : March 26, 1991

INVENTOR(S) : KENICHIRO WAKI, ET AL.

It is certified that error appears in the above-identified patent and that said Letters Patent is hereby corrected as shown below:

COLUMN 10

Line 4, "and component," should read --has an AC component--.

Line 9, "claim 12 to 14," should read --claims 12 to 14,--.

Signed and Sealed this

Fifth Day of January, 1993

*Attest:*

*Attesting Officer*

DOUGLAS B. COMER

*Acting Commissioner of Patents and Trademarks*